US008079922B1

(12) United States Patent
Paterson

(10) Patent No.: US 8,079,922 B1
(45) Date of Patent: Dec. 20, 2011

(54) FREE-STANDING TABLE TENNIS REBOUND SYSTEM

(76) Inventor: Robert Douglas Paterson, Bend, OR (US)

( * ) Notice: Subject to any disclaimer, the term of this patent is extended or adjusted under 35 U.S.C. 154(b) by 0 days.

(21) Appl. No.: 12/845,338

(22) Filed: Jul. 28, 2010

(51) Int. Cl.
*A63B 69/00* (2006.01)
*A63B 69/38* (2006.01)

(52) U.S. Cl. ..... 473/434; 473/459; 473/451; 473/448; 473/462

(58) Field of Classification Search ..... 473/435, 473/422, 434, 433, 454, 462, 474, 475, 476, 473/496; 273/407, 348
See application file for complete search history.

(56) References Cited

U.S. PATENT DOCUMENTS

| | | | | | |
|---|---|---|---|---|---|
| 392,565 | A * | 11/1888 | Larew | 248/464 |
| 3,107,442 | A * | 10/1963 | Levine | 434/417 |
| 4,036,465 | A * | 7/1977 | Kellner | 248/463 |
| 4,565,527 | A * | 1/1986 | Burchett | 434/248 |
| 4,943,056 | A | 7/1990 | Bowers | |
| 5,211,404 | A * | 5/1993 | Grant | 273/407 |
| 5,570,889 | A * | 11/1996 | Tyrer | 273/348.4 |
| 5,829,753 | A * | 11/1998 | Wiser | 273/407 |
| 5,935,024 | A | 8/1999 | Lao | |
| 6,093,120 | A * | 7/2000 | Luke, Jr. | 473/454 |
| 6,155,939 | A * | 12/2000 | Takacs | 473/496 |
| 6,544,132 | B1 * | 4/2003 | Tvedt | 473/448 |
| 6,935,971 | B2 * | 8/2005 | Piras et al. | 473/435 |
| 7,175,549 | B2 * | 2/2007 | LeFlore | 473/448 |
| 7,677,993 | B2 * | 3/2010 | McTavish | 473/459 |
| 7,841,958 | B2 * | 11/2010 | Fleming et al. | 473/496 |
| 7,959,154 | B2 * | 6/2011 | Ball | 273/407 |
| 2004/0023735 | A1 * | 2/2004 | Janton | 473/434 |
| 2004/0157685 | A1 * | 8/2004 | Hodges | 473/448 |
| 2005/0049088 | A1 * | 3/2005 | Chang et al. | 473/434 |

OTHER PUBLICATIONS

Pollak, Michael, "Table Tennis—Training with Feedback", Webpage http://www.returnboard.de/index_E.php accessed Oct. 28, 2010; Germany (excerpted material provided).

* cited by examiner

*Primary Examiner* — Mitra Aryanpour
(74) *Attorney, Agent, or Firm* — Ouimet Law Offices; Jeffrey R. Ouimet

(57) ABSTRACT

A free-standing rebound system for use with a table tennis table wherein the system comprises: paired multi-legged telescoping support stands with an uppermost shaft having an uppermost portion with a hole therein; a mounting assembly including a shaft collar, screw spacer dowel pin and a thumbscrew; and a rectangular, framed rebound board having two rebounding surfaces which may be coated in natural and/or synthetic rubber blends and paired wood insert nuts oppositely arranged at the midpoint on two shorter sides. The apparatus is adjustable to orient the rebound board above the table tennis table at any distance from the net, at any latitudinal angle, or behind the back edge of the table opposite the player at any distance, height or angle as required by the abilities and training goals of the player.

14 Claims, 3 Drawing Sheets

FREE-STANDING TABLE TENNIS REBOUND SYSTEM

BACKGROUND OF THE INVENTION

1. Field of the Invention

The present invention relates generally to table tennis training systems and more specifically to free-standing rebound practice boards for use with table tennis tables.

2. Description of the Prior Art

Rebound or deflection boards for practicing table tennis are well known in the prior art. Each of the prior art devices, while serving the object of providing table tennis rebound practice, has certain deficiencies which the present invention addresses.

First, most of the prior art rebound practice board devices utilize the table tennis table as a support means, thereby limiting the ability to adjust the rebound board horizontally and vertically in relation to the table tennis table. Numerous manufacturers offer table tennis tables on the market at both the consumer and professional levels. These table tennis tables were not designed or intended to be used in conjunction with the rebound practice board devices disclosed in the prior art. The result is that the prior art rebound practice board devices must be made adaptable to these various table tennis table designs, thereby making the rebound board devices more expensive to manufacture, as well as not being compatible with many table tennis table designs. In addition, attaching the rebound board apparatus to the table tennis table limits the ability of the player to switch easily from rebound practice to regular play without a time consuming setup and dismantling procedure.

Another disadvantage of the prior art rebound practice board devices is that they are severely limited in the extent of their horizontal adjustment. When the rebound device is attached to the table tennis table itself, it can only be set at a position between the net and the back edge of the table opposite the player's position. There is no possibility to set the rebound practice board any distance behind the table tennis table without additional costly support structures. Similarly, the prior art devices which rely on the table tennis table for support prevent the player from adjusting the rebound practice board vertically, thereby limiting the use of the board as a training device.

The major shortcoming of the prior art devices' attachment to the table tennis table itself are the inability to simultaneously control both the vertical and horizontal angle of the board to increase the training effect. It is not possible to turn the prior art devices 360° in order to utilize both front and back surfaces of the practice return board. The horizontal adjustment of the prior art rebound practice boards is also limited, which prevents the board from being positioned at an angle to, rather than parallel with, the back edge of the playing surface of the table tennis table.

SUMMARY OF THE INVENTION

With the foregoing disadvantages in mind, it is the object of the present invention is to provide the table tennis player with a low cost rebound practice system featuring easy setup, portability, and maximum adjustability in order to more realistically simulate playing opposite a table tennis trainer or partner. This is achieved by imitating the qualities of a table tennis paddle including the use of different coatings for each side of the rebound board, and simulating the many playing angles, heights and distances the paddle is capable of achieving during training or play.

To attain this, the present invention is comprised of three components: paired telescoping multi-leg support stands, paired mounting assemblies, and a rebound board.

The paired support stands are readily available commercially, providing a cost savings to the consumer. The stands are light in weight, collapsible and therefore compact. The telescoping feature allows for vertical adjustment, enabling the rebound practice board to be adjusted up and down. The uppermost portion of the uppermost telescoping shaft provides a means of attaching the rebound board. The use of two independent support stands allows the rebound system to be free-standing as opposed to attaching to a table tennis table. This enables the player to switch between rebound practice and regular table tennis play without time consuming setup and dismantling. The use of two support stands, as opposed to one single support stand, provides well-balanced support, greater stability, and can adapt to more irregular surfaces. The use of two support stands also allows the rebound practice board to pass over the table tennis table between the support stands, so that the rebound practice board can be adjusted as close to the net, or as far from the net, as the player's abilities and training goals require.

Each of two mounting assemblies consists of three parts: a thumb screw with a male machine screw to engage wood insert nuts on the rebound board; a screw spacer dowel pin; and a shaft collar.

The mounting assembly allows for easy mounting and dismounting of the rebound board to and from the support stands by simply passing the thumb screw through a shaft collar, a screw spacer dowel pin and a hole in the uppermost portion of the uppermost telescoping shaft of the support stand and into the wood insert nut on the rebound board.

All of the parts for the mounting assembly, with the exception of shaft collar, are inexpensive and readily available commercially. The shaft collar is inexpensive to manufacture.

The rebound board is light in weight and adjustable latitudinally through 360 degrees, allowing it to be oriented at different angles in relation to the playing surface of the table tennis table and allowing the use of both the front and back surfaces of rebound board, as appropriate to a player's abilities and training goals. Either or both sides of the rebound board can be coated with a low durometer rubber with excellent elastic and rebound characteristics for advanced play, and/or with a higher durometer, less elastic rubber for novice to intermediate play. A pair of wood insert nuts located on each of the shorter edges of the rebound board receive the thumbscrews of the mounting assemblies which, when tightened, provide a braking force to keep the rebound board locked in the desired position.

DETAILED DESCRIPTION OF THE INVENTION

Figure 1:
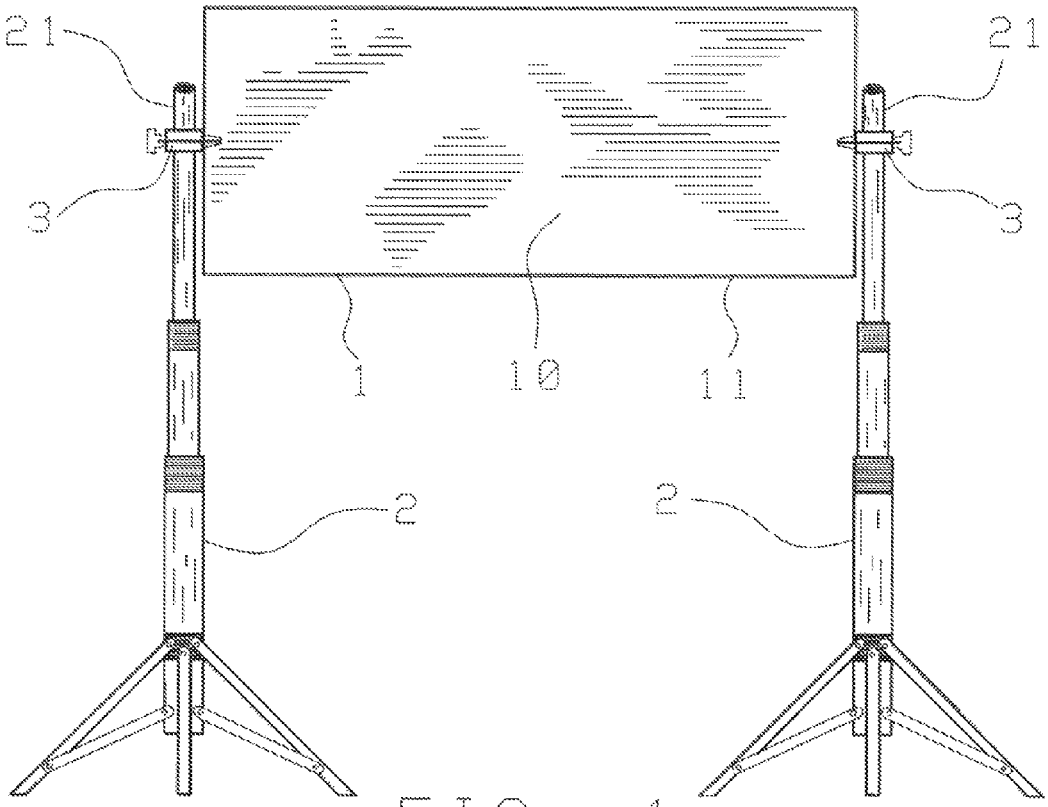
FIG. 1 is an overall front view of the free-standing table tennis rebound system.

As can be seen by reference to the drawings and in particular to FIG. 1, the free-standing table tennis rebound system that forms the basis of the present invention comprises in general: a rebound board (1) formed of wood and having two oppositely arranged rebound surfaces (10) and a surrounding wood frame (11); two mounting assemblies (3); and, two height-adjustable telescoping multi-leg support stands (2) having an uppermost portion of an uppermost shaft (21) for attachment via the mounting assemblies.

As best shown in FIG. 1, in a preferred embodiment of the invention the rebound board (1) is attached via mounting assemblies (3) to the uppermost portion of the uppermost shaft of a pair of telescoping multi-leg support stands (2).

Figure 2:
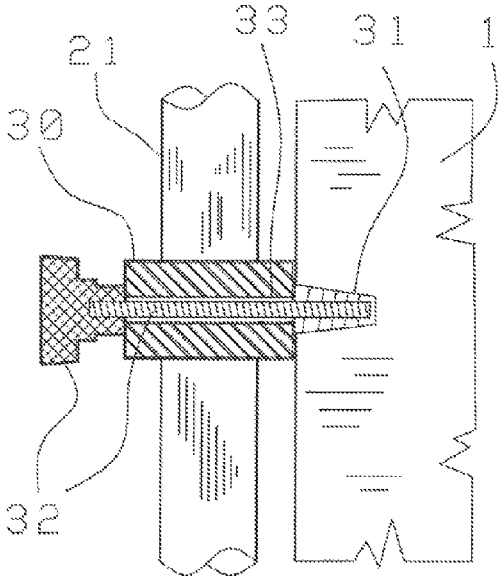
FIG. 2 is an exploded side view of the mounting assembly.
Figure 3:
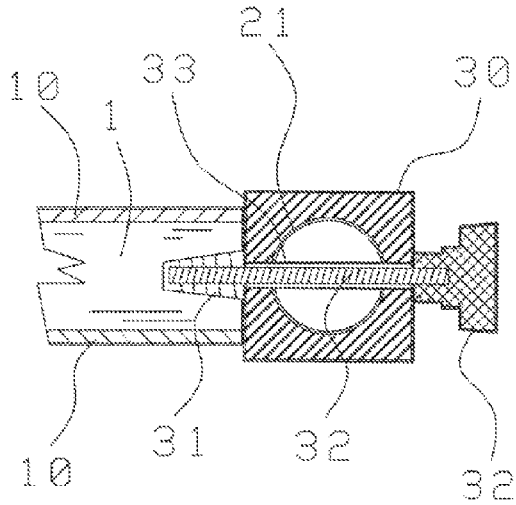
FIG. 3 is an exploded top view of the mounting assembly.
Figure 4:
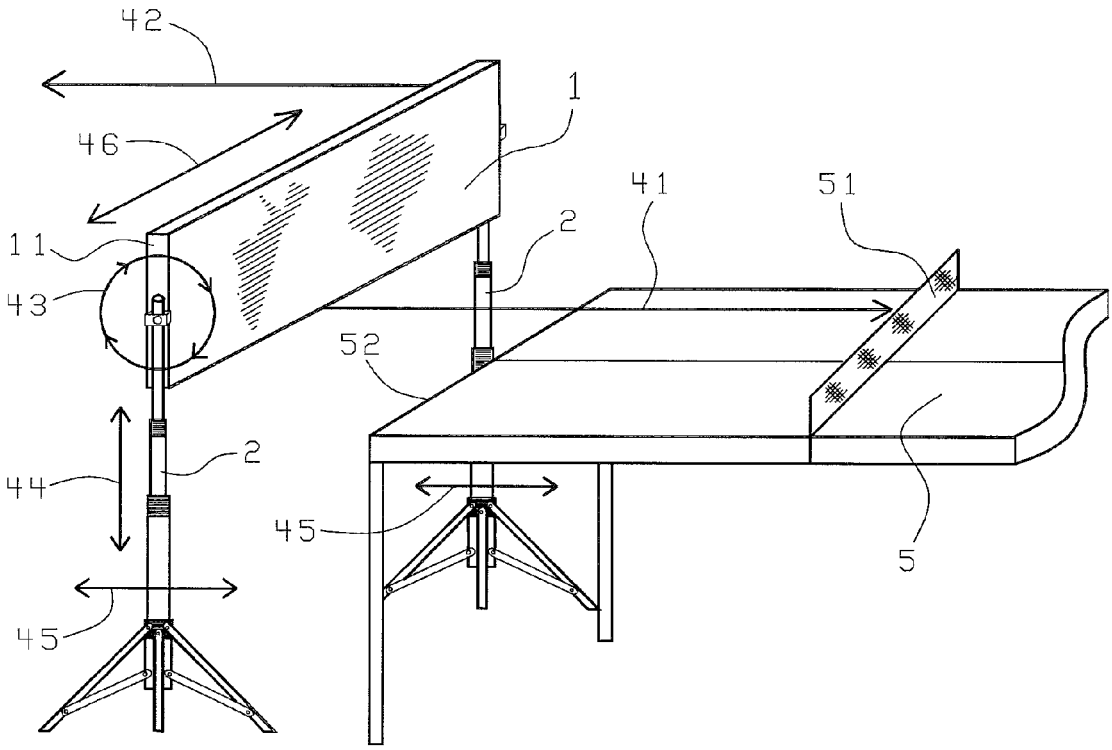
FIG. 4 is an overall perspective view of the free-standing table tennis rebound system in one orientation relative to a table tennis table detailing each adjustment.

As seen in FIGS. 1, 2 and 4, the rebound board (1) is a rectangular board wider than the narrower dimension of a standard table tennis table. At the midpoint on each edge of its narrower dimension the rebound board (1) is provided with wood insert nuts (31) passing into the frame (11) to provide attachment to the multi-leg support stands (2) via the mounting assemblies (3). The two rebound surfaces (10) on either side of the rebound board (1) may be covered with sheet rubber. Either or both of the sides may be covered with a lower durometer rubber such as natural or pure gum rubber which, because of its excellent tackiness, elasticity and pliability has high bounce and spin qualities suitable for the advanced player and/or with a higher durometer rubber blend which, while still producing high bounce, produces less spin. Such higher durometer coatings include styrene butadiene rubber (also known as red sheet or SBR rubber), ethylene propylene diene monomer rubber (E.P.D.M. rubber), neoprene-rubber blends and nitrile-rubber blends.

Figure 5:
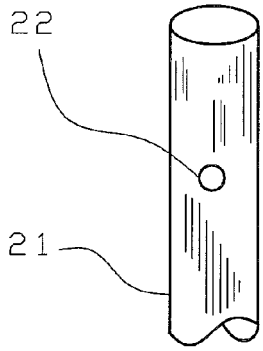
FIG. 5 is a side view of the uppermost portion of the uppermost shaft of a support stand showing the engagement hole.
Figure 6:
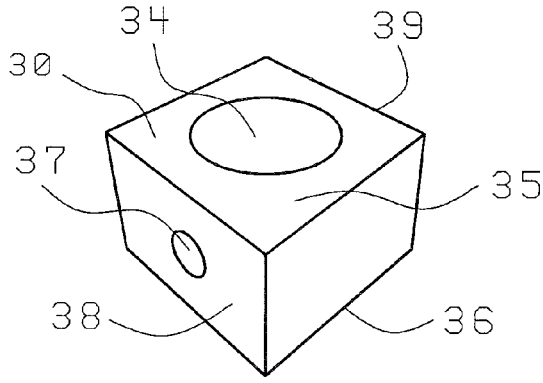
FIG. 6 is a perspective view of the shaft collar.

As seen in FIG. 5, each of the adjustable telescoping multi-leg support stands (2) has an uppermost shaft having an uppermost portion (21), which uppermost portion (21) has a hole (22) in it to allow coupling the rebound board (1) to the multi-leg support stands (2) via the mounting assemblies (3).

As seen in FIGS. 2, 3, 5 and 6, each mounting assembly comprises a shaft collar (30) formed as a cube with an attachment shaft engagement hole (34) passing through the shaft collar from its top face (35) to its bottom face (36) which facilitates attachment to the free-standing multi-leg support stand by allowing the uppermost portion of the uppermost shaft (21) to pass through it. The shaft collar is attached with the screw spacer dowel pin (33) which is inserted through the shaft collar via a spacer hole (37) passing from one side face (38) of the shaft collar to an oppositely arranged second side face (39) of the shaft collar, and through the hole (22) in the uppermost portion of the uppermost shaft (21), and a thumbscrew (32) is inserted through the screw spacer dowel pin (33) to engage the wood insert nuts (31) of the rebound board (1).

As the thumbscrew (32) is tightened, pressure is exerted between the rebound board (1) and the shaft collar (30), creating a braking force which locks the rebound board (1) into a fixed position and keeps the rebound board (1) from rotating. Releasing tension of the thumbscrew (32) allows the rebound board (1) to be rotated to other positions. The rebound board may thus be adjusted to any angle relative to the playing surface of the table tennis table between 0° and 360°.

FIG. 4 shows a perspective view of the free-standing table tennis rebound system in relation to a table tennis table (5) and all of the adjustments of which the table tennis rebound apparatus is capable.

Further referring to FIG. 4, the preferred embodiment of the invention is seen to be capable of numerous adjustments. The most appropriate placement of the apparatus depends on the ability of the player to hit the ball such that it strikes the rebound board and returns to remain in play, and the player's goals in training to improve such abilities. As shown by the arrow (41), the free-standing table tennis rebound apparatus may be positioned suspended over the table tennis table (5) at a point from immediately adjacent to the net (51), as would be appropriate for the novice player, or, as shown by the arrow (42), to a position beyond the back edge (52) of the table tennis table (5) as much as 10' in the case of the most skilled players. As further shown by the arrow (43), the rebound board (1) may be rotated 360° in order to provide an angled surface to challenge the player, a completely vertical position at 0° being appropriate to a novice player while a greater angle would be appropriate to a more skilled player. As further shown by the arrow (44) the height of the free-standing table tennis rebound system may be adjusted such that the lowest latitudinal surface of the rebound board (1) is at a plane parallel to the horizontal playing surface of the table tennis table (5), appropriate to a novice player, to a height above such plane as the upper limits of the support stands (2) will allow and which accommodates the skills and training goals of advanced players. As further shown by the arrow (45) each of the support stands (2) may be independently moved forward or backward such that the rebound board (1) is at an angle to the playing surface of the table tennis table (5) between 0°, appropriate for the novice player to as much as 45°, appropriate to the training needs of the most skilled player. Finally, as shown by the arrow (46), the rebound apparatus may be positioned to the left or right of a centerline of the table tennis table (5) perpendicular to the net (51), wherein the appropriate position for a novice player is centered on the centerline of the table, and the appropriate position for an advanced player being further offset from the centerline up to a distance of 10'. As can be appreciated, the apparatus is capable of many combinations of adjustments to suit the skill level and training goals of a particular player.

Figure 7:
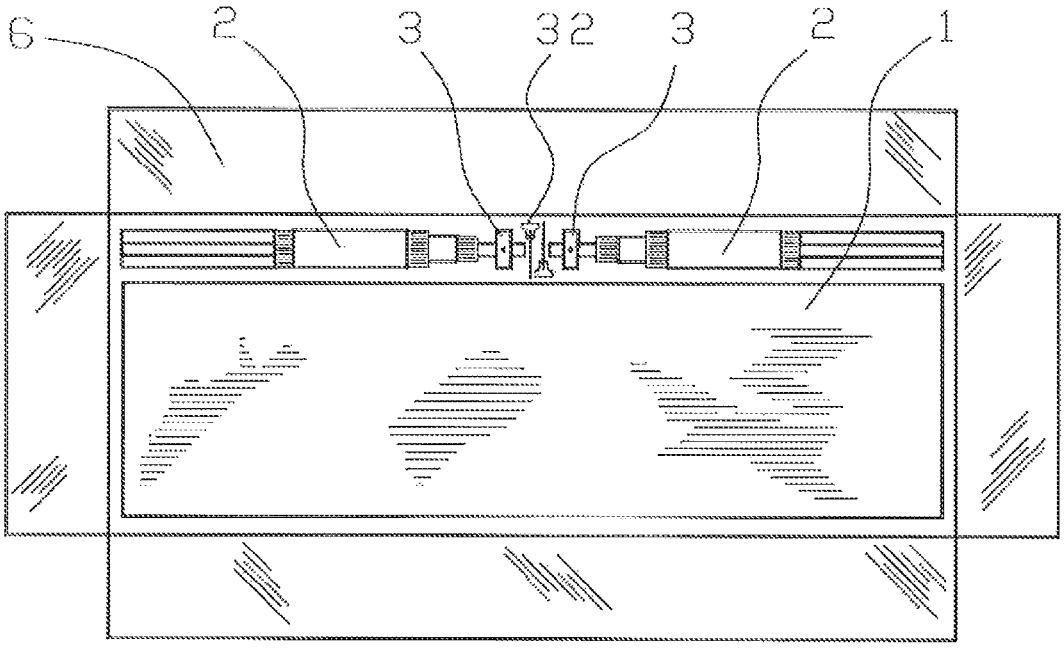
FIG. 7 is a top view of a container for storing or packaging the free-standing rebound system.

FIG. 7 shows a top view of a container (6), in one orientation, storing or packaging the free-standing table tennis rebound apparatus. In this orientation, a pair of telescoping support stands (2), shown in a collapsed state and with mounting assembly (3) attached, packaged next to rebound board (1) and thumb screws (32) within container (6).

What is claimed is:

1. A free-standing table tennis ball rebound apparatus for use with a table tennis table having a horizontal rectangular playing surface in which two oppositely arranged shorter sides comprise a front and a back edge and two oppositely arranged longer sides comprise two side edges, and a net extending between the side edges and running parallel to the front and back edges in the center of the playing surface, wherein the apparatus comprises:

paired free-standing support stands, each comprising a plurality of legs and surmounted by an uppermost shaft having an uppermost portion adapted for mounting;

paired mounting assemblies comprising a shaft collar for engaging the uppermost portion of the uppermost shaft of the support stand, a screw spacer dowel pin inserted through the shaft collar and the uppermost portion of the uppermost shaft of the support stand, and a threaded thumbscrew for inserting through the screw spacer dowel pin, the shaft collar, and the uppermost portion of the uppermost shaft of the support stand; and, a ball rebound board formed of wood and comprising a rectangle having two shorter edges and two longer edges defining two oppositely arranged rebound surfaces, with a frame formed of wood, and wherein wood insert nuts are positioned at the midpoint of each of the two shorter edges for mounting to the paired support stands via the mounting assemblies.

2. The free-standing ball rebound apparatus as claimed in claim 1, wherein the uppermost portion of the uppermost shaft of the support stand has a hole passing through it in a direction perpendicular to the vertical axis of said uppermost shaft to enable mounting of the shaft collar to the uppermost portion of the uppermost shaft.

3. The free-standing ball rebound apparatus as claimed in claim 2, wherein the shaft collar is formed as a cube with a shaft engagement hole extending from a top face to an oppositely positioned bottom face and wherein the shaft engagement hole is positioned and dimensioned to engage the uppermost portion of the uppermost shaft of the support stand.

4. The free-standing ball rebound apparatus as claimed in claim 3, wherein a spacer hole extends between a first side face of the shaft collar and an oppositely positioned second side face of the shaft collar and is positioned perpendicular to the shaft engagement hole and wherein the spacer hole is positioned and dimensioned to receive the screw spacer dowel pin.

5. The free-standing ball rebound apparatus as claimed in claim 4, wherein the screw spacer dowel pin is formed as a cylinder dimensioned to fit within the spacer hole of the shaft collar and the hole of the uppermost portion of the uppermost shaft of the support stand.

6. The free-standing ball rebound apparatus as claimed in claim 5, wherein the threaded thumbscrew is inserted through the shaft collar via the screw spacer dowel pin and the hole of the uppermost portion of the uppermost shaft of the support stand to engage the wood insert nuts and provide attachment of the rebound board to the support stands and whereby tightening the thumbscrew provides a braking force between the mounting mechanisms and the rebound board to lock the rebound board in place.

7. The free-standing ball rebound apparatus as claimed in claim 6, wherein one or both of the rebound surfaces of the rebound board are coated with a coating chosen from the group consisting of: natural rubber, pure gum rubber, styrene butadiene rubber (SBR rubber), ethylene propylene diene monomer rubber (EPDM rubber), neoprene-rubber blend, and nitrile-rubber blend.

8. The free-standing ball rebound apparatus as claimed in claim 7, wherein the rebound surfaces of the rebound board can be rotated and locked at any angle between 0° and 360° relative to the table tennis table playing surface by rotation about a latitudinal line extending between the wood insert nuts as appropriate to a player's abilities and training goals.

9. The free-standing ball rebound apparatus as claimed in claim 7, wherein the apparatus may be positioned with the lower latitudinal edge of the rebound board above the table tennis table playing surface between a point substantially adjacent and parallel to the net and a point substantially at and parallel to the back edge of the table tennis table opposite the player as appropriate to the player's skill and training goals.

10. The free-standing ball rebound apparatus as claimed in claim 7, wherein the apparatus may be positioned substantially beyond and parallel to the back edge of the table tennis table opposite the player at a distance from the back edge appropriate to the player's abilities and training goals.

11. The free-standing ball rebound apparatus as claimed in claim 7, wherein the independent support stands may be moved independently forward or backward to position the rebound surface of the rebound board at an angle to the back edge of the table tennis table opposite the player appropriate to the player's abilities and training goals.

12. The free-standing ball rebound apparatus as claimed in claim 7, wherein the apparatus may be positioned beyond the back edge of the table tennis table opposite the player and at an offset relative to a centerline of the table tennis table playing surface to the left or the right a distance appropriate to the player's abilities and training goals.

13. The free-standing ball rebound apparatus as claimed in claim 7, wherein the height of the rebound board as measured along a lowest latitudinal edge of the rebound board is adjusted vertically above the plane of the table tennis table playing surface as appropriate to the player's abilities and training goals.

14. The free-standing ball rebound apparatus as claimed in claim 1, wherein the apparatus is disassembled and placed in a carton such that the rebound board is laid flat, the paired support stands are laid adjacent to a side of the rebound board along its long axis and the uppermost portions facing each other, the shaft collars are engaged with the uppermost portions of the uppermost shafts, and the thumbscrews are laid between them.

* * * * *